United States Patent [19]

Hughes

[11] Patent Number: 4,793,613

[45] Date of Patent: Dec. 27, 1988

[54] HOCKEY STICK

[76] Inventor: Owen P. Hughes, 155 Messinger St., Canton, Mass. 02021

[21] Appl. No.: 201,570

[22] Filed: Jun. 1, 1988

Related U.S. Application Data

[62] Division of Ser. No. 34,032, Apr. 1, 1987.

[51] Int. Cl.[4] ..... A63B 59/00

[52] U.S. Cl. ..... 273/67 A

[58] Field of Search ..... 273/67 A, 67 R, 81.3, 273/ 67 DL; D21/210-213

[56] References Cited

U.S. PATENT DOCUMENTS

| | | | |
|---|---|---|---|
| 1,657,473 | 1/1928 | Howard | 273/81.3 |
| 2,412,245 | 11/1959 | Gardner et al. | 273/67 A |
| 3,062,549 | 11/1962 | Dadem . | |
| 3,489,412 | 1/1970 | Franck et al. | 273/67 A |
| 3,563,546 | 2/1971 | Dawe | 273/67 A |
| 4,076,240 | 2/1978 | Haddad . | |
| 4,172,594 | 10/1979 | Diedrich | 273/67 A |
| 4,353,549 | 10/1982 | Goupil . | |
| 4,512,573 | 4/1985 | Coolen . | |
| 4,544,157 | 10/1985 | Curtis | 273/67 A |
| 4,629,190 | 12/1986 | Borgen . | |

FOREIGN PATENT DOCUMENTS

| | | | |
|---|---|---|---|
| 104613 | 8/1938 | Australia . | |
| 1159485 | 12/1983 | Canada . | |
| 45211 | 5/1928 | Norway . | |
| 935114 | 6/1982 | U.S.S.R. | 273/67 A |
| 419317 | 11/1934 | United Kingdom | 273/81.3 |

*Primary Examiner*—Richard C. Pinkham
*Assistant Examiner*—Mark S. Graham
*Attorney, Agent, or Firm*—Gregory A. Madera

[57] ABSTRACT

A hockey stick includes a blade having forehand and backhand puck striking surfaces. The forehand surface is concavely curved throughout substantially the entire length of the blade, and the blade is bifurcated in the toe region to provide fore and back toe segments that are independently transversely flexible. The blade may be employed in combination with a curved handle, and may have a forehand surface inclined in the forehand direction for relatively greater effective curvature. A cushioning blade toe end cover is also described.

3 Claims, 2 Drawing Sheets

HOCKEY STICK

BACKGROUND OF THE INVENTION

This application is a division of copending application Ser. No. 07/034,032 filed Apr. 1, 1987.

The invention relates to hockey sticks.

Hockey sticks currently used by National Hockey League players have a blade that is longitudinally curved from heel to toe, the blade being concavely shaped on the forehand puck striking surface for improved control when receiving, manuevering and shooting the puck from the forehand.

Cote U.S. Pat. No. 4,570,932 suggested an ice hockey stick having separate forehand and backhand blade portions, each defining puck striking surfaces, and a wedge, e.g., of plastic material, between the blade portions, to provide a curved forehand surface and a straight backhand surface.

SUMMARY OF THE INVENTION

According to the invention, in a hockey stick having a handle, and an elongated blade extending from a heel portion at one end of the handle and terminating in a bifurcated toe portion at an end spaced from the heel portion, the blade defining a concavely curved forehand puck striking surface terminating in a fore toe segment and a backhand puck striking surface terminating in a back toe segment, there is an improvement wherein the backhand puck striking surface terminating in the back toe segment is curved along at least a portion of its length, and the fore toe segment and the back toe segment are spaced apart in a manner to allow the toe segments to flex independently for improved puck control on the forehand and on the backhand.

In preferred embodiments, the backhand puck striking surface is concavely curved throughout substantially the entire length of the blade; the backhand puck striking surface is concavely curved from a median line along the blade to the toe portion of the blade, preferably the blade further comprising a playing surface engaging edge, the edge terminating upon the bifurcated toe segments, the playing surface engaging edge of the back toe segment, when the puck striking surfaces are disposed substantially normal to a playing surface, extending upwardly, out of engagement with the playing surface in a manner to allow the forehand puck striking surface to be inclined for a forehand "roofing" or "lift" shot; the handle curves longitudinally throughout its length, the handle having a backhand surface lying forwardly of a plane generally through the backhand puck striking surface; and the forehand puck striking surface has a toe end and a heel end, and is inclined toward the forehand direction relative to a position in which the heel end of the curve lies generally tangent to a plane of the forehand surface of the handle, whereby the surface has an effective curvature relatively greater than a conventional curved blade of comparable measured curvature.

According to another aspect of the invention, a protective sleeve for use with a hockey stick blade is sized and constructed to fit snugly about a toe segment of the blade. Preferably the protective sleeve comprises a hard rubber material.

According to still another aspect of the invention, the forehand puck striking surface of a curved blade has toe and heel ends and is inclined toward the forehand direction relative to a position in which the heel end of the curve lies generally tangent to a plane through the forehand surface of the associate handle or blade shaft.

The blade and handle of the invention may be used separately, in combination, respectively, with handles and blades of other configurations.

Thus there is provided a hockey stick blade that allows the user the improved control of a curved puck striking surface on both the forehand and backhand, while still providing flexibility at the toe end of the blade; and, further, there is provided a blade having separate forehand and backhand puck striking surfaces that allows the user to incline the stick on the forehand for lifting the puck with the toe end of the blade. There are also provided an improved curved stick handle, and a protective sleeve for the blade toe end.

Other features and advantages of the invention will be apparent from the following description of the preferred embodiments, and from the claims.

DESCRIPTION OF THE PREFERRED EMBODIMENT

I turn now to the structure and operation of the preferred embodiment, after first briefly describing the drawings.

STRUCTURE

Figure 1:
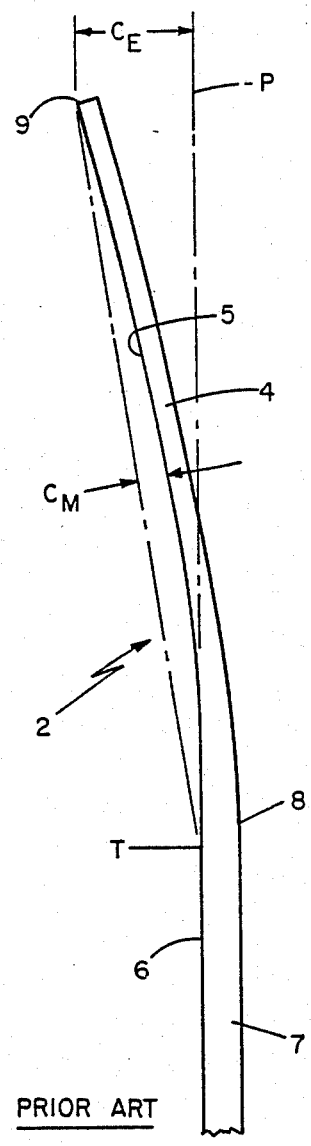
FIG. 1 is a plan view of a prior art hockey stick having a regulation curved blade.

Referring to FIG. 1, there is shown one typical prior art hockey stick 2, having a conventional curved blade 4, the curved forehand puck striking surface 5 lying generally tangent to the plane, P, of the forehand surface 6 of the stick handle 7 at point T, at the heel 8 of the blade, and extending longitudinally in a concave shape to blade toe 9. (For clarity, the blade is shown in a simple profile, without representation of variation of the vertical incline, as would be typical.) In National Hockey League play, the maximum depth of the curve ($C_M$) of puck striking surface 5 is 0.5 inch, resulting in an effective curvature of $C_E$, measured from the plane of surface 6.

Figure 2:
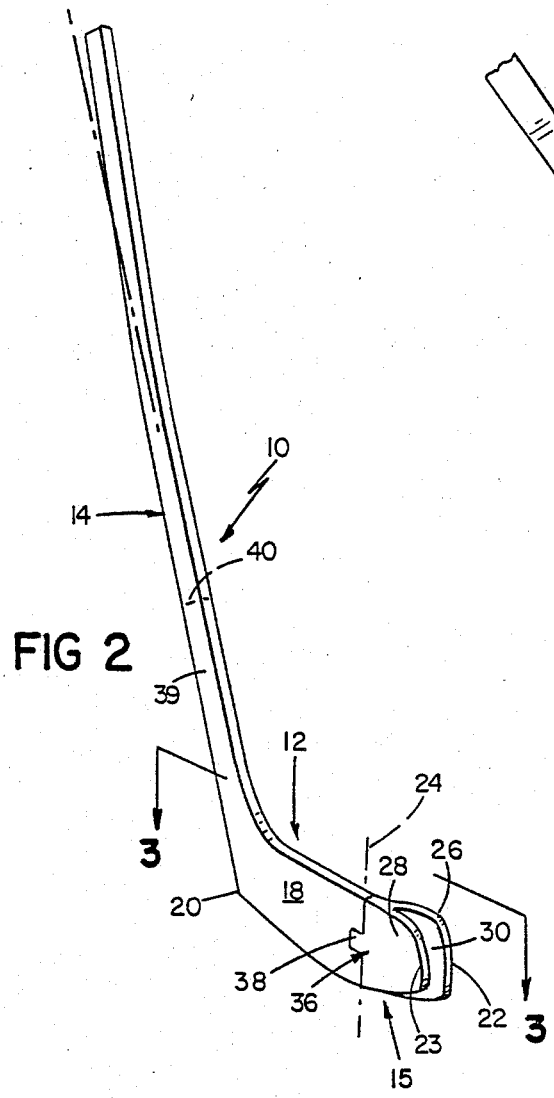
FIG. 2 is a perspective view of a hockey stick constructed in accordance with the present invention.
Figure 2C:
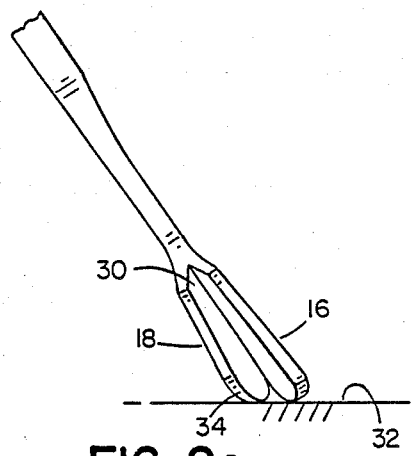
FIG. 2*c* is a front elevation of the hockey stick blade of FIG. 2 in position to make a roofing shot.
Figure 2A:
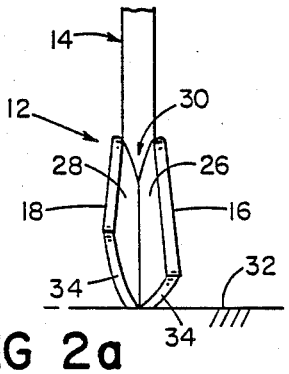
FIG. 2*a* is a front elevation of the hockey stick blade of FIG. 2.

In FIGS. 2 and 2*a*, there is shown a hockey stick 10 of the invention, having blade 12 and a handle 14. Blade 12 terminates in a bifurcated toe portion 15 and has a forehand puck striking surface 16 and a backhand puck striking surface 18. The forehand surface 16 is uniformly, gradually curved longitudinally throughout substantially the entire length of the blade from the heel 20 to the toe end 22, the curve producing a shallow concave surface.

The backhand surface 18 of the blade is essentially straight between the heel of the blade and median line 24 of the blade, which is located about two-thirds along the length of blade from the heel, in the direction of the toe. From the line 24 forwardly to the toe end 23 of the blade, the backhand surface is gradually and uniformally curved divergently from the forehand surface, with approximately the same degree of curvature as the forehand surface.

The toe region of the blade is bifurcated into fore toe segment 26 and back toe segment 28. Space 30 separates toe segments 26 and 28, allowing them to flex independently.

When the blade is disposed with the surfaces 16, 18 of the blade substantially normal to the playing surface 32, the lower playing surface-engaging edge 34 in the region of the rear toe segment 28 extends at an angle, away from engagement with the playing surface, e.g., the lower edge of the back toe segment 28 at the toe end 23 is about ½ inch above the lower edge of the fore toe segment 26.

Preferably, the toe of the blade is covered by protective sleeve 36. The sleeve is made of a hard, rubber material, about 1/32 to 1/16 inch thick. The sleeve is designed to fit snugly over the toe of the blade, and, prior to use, the sleeve 36 may be affixed to the blade, e.g., by wrapping tape around the blade in the area of tabs 38.

Figure 2B:
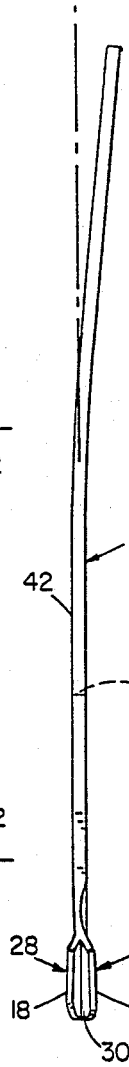
FIG. 2*b* is a front elevation of the hockey stick of FIG. 2.

Referring to FIG. 2*b*, shaft or handle 14 is gradually and uniformally curved throughout its length generally from the point 40, where the handle is joined to the blade 12, to the upper end. The shaft backhand surface 42 is forward of the backhand puck striking surface 18. The shaft curvature is somewhat exaggerated in degree in FIG. 2 for the sake of clarity of illustration; the top end of the shaft backhand surface 42 is typically offset by about one-half inch from the point 40 where shaft curvature begins.

USE

The blade of the invention allows for good control and velocity of both forehand and backhand passes and shots.

Referring to FIG. 2*c*, the raised tip of the lower edge 34 in the region of the back toe segment 28 allows the stick handler to rock the toe end of the blade towards the backhand surface while keeping the lower edge of the fore toe segment 26 on the ice 32 in position for a "roofing" or lift shot, which involves getting under the puck with the toe end of the forehand face and lifting the puck off the ice. The shot is the common means by which a goal is scored in the upper corners of the hockey net. Keeping the lower edge of the forehand toe member on the ice allows for good control of the shot. Also, on the forehand, the offsetting of the shaft 14 forwardly of the general plane of the backhand surface of the blade causes the blade to produce greater puck velocity, and the curved shaft enables better stick handling and control when passing or shooting the puck.

The space 30 provided between the fore and back toe segments allows the toe members to flex independently of each other. This independent transverse flexibility allows the stick handler to get better velocity and control of a puck that strikes the blade in the toe region, both on the forehand, and on the backhand.

The sleeve 36 cushions a blow if the toe of a blade makes contact with another player, and thus helps to protect hockey players from serious injury.

ALTERNATE EMBODIMENTS

Figure 6:
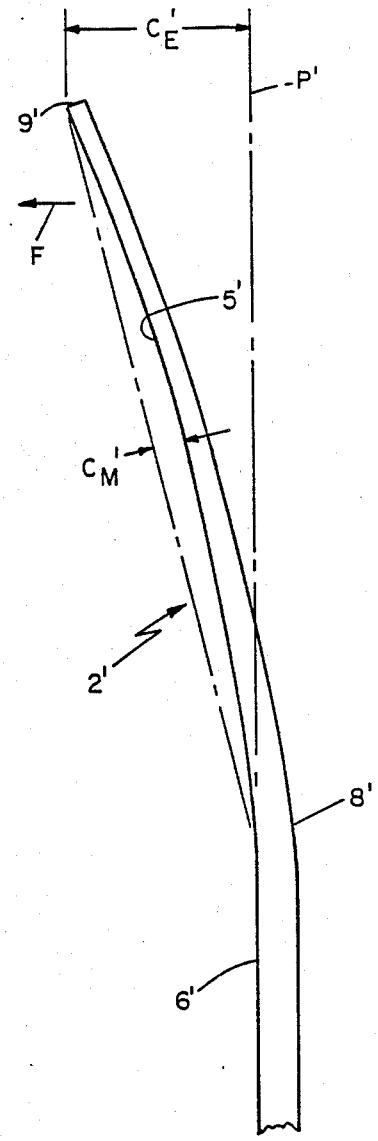
FIG. 6 is a plan view of a conventional hockey stick with an offset blade.

Referring to FIG. 6, to provide a greater degree of effective curvature ($C_F'$) in a conventional hockey blade 2', without exceeding the limitation of measured curvature ($C_M'$), the toe end 9' of the forehand puck striking surface 5' is angled toward the forehand direction (arrow F) from the heel 8' of the blade. The resulting effective curvature ($C_E'$) is greater than the effective curvature ($C_E$) of the blade of FIG. 1 for improved accuracy and velocity, while the measured curvature ($C_M$) is unaffected.

Figure 7:
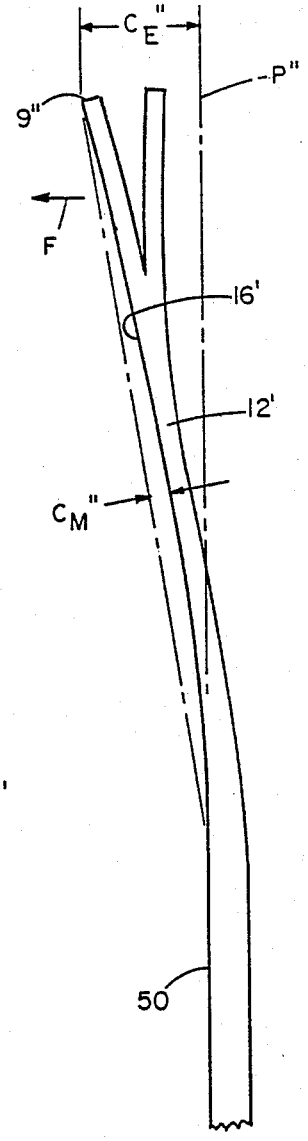
FIG. 7 is a plan view of a bifurcated hockey stick with an offset blade.

In a bifurcated hockey blade of the invention, the degree of measured curvature ($C_M''$) of the forehand puck striking surface affects the curvature of the backhand puck striking surface, except in the toe region. As discussed above, the backhand toe also restricts the ability of a player to lift the puck in a roofing shot, particularly with a more severely curved forehand puck striking surface. Referring to FIG. 7, the forehand puck striking surface 16' of a bifurcated hockey blade 12' of the invention has a measured curvature ($C_M''$) less than the maximum allowed, e.g., ⅜ inch, but the toe end 9'' of surface 16' is inclined toward the forehand direction (arrow F) from the plane P'' of the handle (or blade shaft) forehand surface 50 to provide a relatively greater effective curvature ($C_E''$) and better accuracy and velocity. The inclination of the forehand puck striking surface also advantageously affects the backhand puck striking surface for improved stick handling, passing and shooting on the backhand.

OTHER EMBODIMENTS

Figure 3:
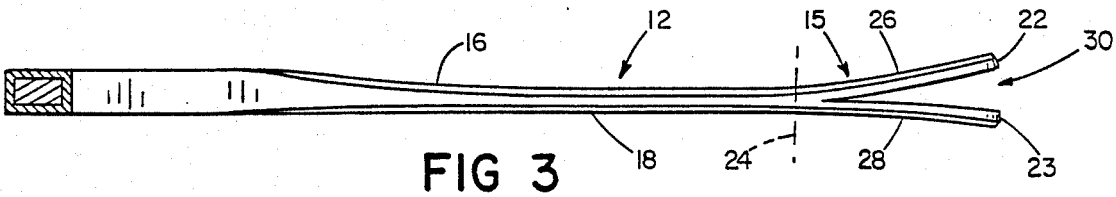
FIG. 3 is a plan view of the hockey stick blade of FIG. 2.
Figure 4:
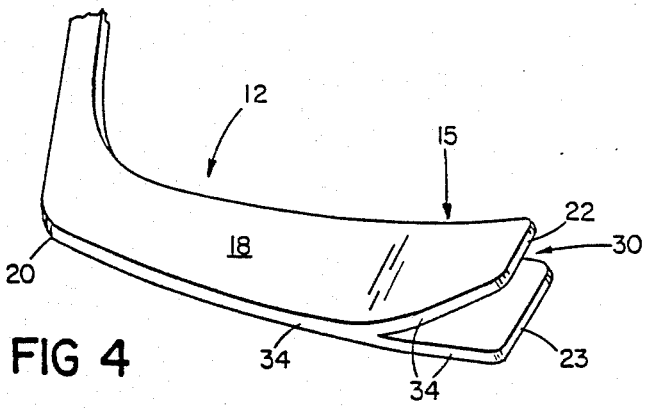
FIG. 4 is a perspective view of the backhand puck striking face of the hockey stick blade of FIG. 2, without the protective sleeve.
Figure 5:
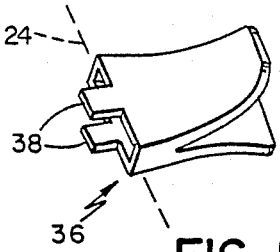
FIG. 5 is a perspective view of the protective sleeve for the toe of the hockey stick blade.

Other embodiments are within the following claims. For example, the backhand puck striking surface can be straight (FIG. 4) or can be concavely curved (FIG. 3) throughout substantially the entire length of the blade. Moreover, the protective sleeve can be designed to cover the toe region of conventional hockey stick blades. The blade portion at shaft 39 and handle portion may be separable, e.g., at line 40, for replacement of either components.

It will also be appreciated that the stick and blade of the invention may be used for ice hockey or street hockey, where a ball is substituted for the puck.

I claim:

1. In a hockey stick having a handle, and an elongated blade extending from a heel portion at one end of said handle and terminating in a bifurcated toe portion at an end spaced from said heel portion, said blade defining a concavely curved forehand puck striking surface terminating in a fore toe segment and a backhand puck striking surface terminating in a back toe segment, the improvement wherein said fore toe segment and said back toe segment are spaced apart, have an open space between them, define an acute angle between them, and are longer than they are thick so as to allow said toe segments to flex independently for improved puck control on the forehand and on the backhand, and said blade further comprises a playing surface engaging edge, said edge terminating upon said bifurcated toe segments, each of said toe segments also having a playing surface engaging edge, the playing surface engaging edge of said back toe segment, when said puck striking surfaces are disposed substantially normal to a playing surface and the playing surface engaging edge of said fore toe segment contacts the playing surface, extending upwardly, out of engagement with said playing surface in a manner to allow the forehand puck striking surface to be inclined for a forehand "roofing" or "lift" shot.

2. In a hockey stick having a handle, and an elongated blade extending from a heel portion at one end of said handle and terminating in a bifurcated toe portion at an end spaced from said heel portion, said blade defining a concavely curved forehand puck striking surface terminating in a fore toe segment and a backhand puck striking surface terminating in a back toe segment, the improvement wherein said backhand puck striking surface terminating in said back toe segment is concavely curved along at least a portion of its length, and said fore toe segment and said back toe segment are spaced apart, have an open space between them, define an acute angle between them, and are longer than they are thick so as to allow said toe segments to flex independently for improved puck control on the forehand and on the backhand, said backhand puck striking surface being concavely curved throughout substantially the entire length of said blade, said blade further comprising a playing surface engaging edge, said edge terminating upon said bifurcated toe segments, each of said toe segments also having a playing surface engaging edge, the playing surface engaging edge of said back toe segment, when said puck striking surfaces are disposed substantially normal to a playing surface and the playing surface engaging edge of said fore toe segment contacts the playing surface, extending upwardly, out of engagement with said playing surface in a manner to allow the forehand puck striking surface to be inclined for a forehand "roofing" or "lift" shot.

3. In a hockey stick having a handle, and an elongated blade extending from a heel portion at one end of said handle and terminating in a bifurcated toe portion at an end spaced from said heel portion, said blade defining a concavely curved forehand puck striking surface terminating in a fore toe segment and a backhand puck striking surface terminating in a back toe segment, the improvement wherein said backhand puck striking surface terminating in said back toe segment is concavely curved along at least a portion of its length, and said fore toe segment and said back toe segment are spaced apart, have an open space between them, define an acute angle between them, and are longer than they are thick so as to allow said toe segments to flex independently for improved puck control on the forehand and on the backhand, said backhand puck striking surface being concavely curved from a median line along said blade to the toe portion of said blade, said blade further comprising a playing surface engaging edge, said edge terminating upon said bifurcated toe segments, each of said toe segments also having a playing surface engaging edge, the playing surface engaging edge of said back toe segment, when said puck striking surfaces are disposed substantially normal to a playing surface and the playing surface engaging edge of said fore toe segment contacts the playing surface, extending upwardly, out of engagement with said playing surface in a manner to allow the forehand puck striking surface to be inclined for a forehand "roofing" or "lift" shot.

* * * * *

UNITED STATES PATENT AND TRADEMARK OFFICE

CERTIFICATE OF CORRECTION

PATENT NO. : 4,793,613

DATED : December 27, 1988

INVENTOR(S) : Owen P. Hughes

It is certified that error appears in the above-identified patent and that said Letters Patent is hereby corrected as shown below:

On the Title Page, in the Abstract, insert at the end --The playing surface engaging edges of the toe segments are arranged so that the blade may be inclined for a "roofing" or "lift" shot.--

Column 4, line 9, "($C_F$') should be --($C_E$')--,

Signed and Sealed this

Sixteenth Day of May, 1989

*Attest:*

*Attesting Officer*

DONALD J. QUIGG

*Commissioner of Patents and Trademarks*